US005235814A

United States Patent [19]

Leonard

[11] Patent Number: 5,235,814

[45] Date of Patent: Aug. 17, 1993

[54] FLASHBACK RESISTANT FUEL STAGED PREMIXED COMBUSTOR

[75] Inventor: Gary L. Leonard, Cincinnati, Ohio

[73] Assignee: General Electric Company, Schenectady, N.Y.

[21] Appl. No.: 989,727

[22] Filed: Dec. 10, 1992

Related U.S. Application Data

[63] Continuation of Ser. No. 738,990, Aug. 1, 1991, abandoned.

[51] Int. Cl.[5] ..... F02C 7/08

[52] U.S. Cl. ..... 60/738; 60/742

[58] Field of Search ..... 60/737, 738, 746, 747, 60/758, 760, 742

[56] References Cited

U.S. PATENT DOCUMENTS

| | | | |
|---|---|---|---|
| 4,112,676 | 9/1978 | DeCorso . | |
| 4,262,482 | 4/1981 | Roffe et al. | 60/738 |
| 4,338,360 | 7/1982 | Cavanagh et al. | 427/292 |
| 4,344,280 | 8/1982 | Minakawa et al. | 60/747 |
| 4,408,461 | 10/1983 | Bruhwiler . | |
| 4,967,561 | 11/1990 | Bruhwiler et al. | 60/737 |
| 5,121,597 | 6/1992 | Urushidani et al. | 60/39.06 |

FOREIGN PATENT DOCUMENTS

| | | |
|---|---|---|
| 0371250 | 6/1990 | European Pat. Off. . |
| 2060436 | 5/1981 | United Kingdom . |
| 2107448 | 4/1983 | United Kingdom . |

*Primary Examiner*—Richard A. Bertsch
*Assistant Examiner*—Michael I. Kocharov
*Attorney, Agent, or Firm*—James R. McDaniel; Paul R. Webb, II

[57] ABSTRACT

In order to reduce emissions of $NO_x$, CO and unburned hydrocarbons, the flame temperature must be kept between 2500°-2800° F. Premixing combustor tubes are used to premix the fuel and air before the mixture is burned in the combustion chamber. The tubes are flashback resistant due to the flow of the fuel and air mixture through them. If it is desired to reduce the load operation of the combustor to substantially below 100% of its maximum load operation, as is the case during off-peak hours, the fuel and air flow rate can be regulated to reduce the load operation while still keeping the low emissions and the low flame temperature.

8 Claims, 7 Drawing Sheets

FIG. 6

FUEL SCHEDULE

| | $\phi_{12}$ | $\phi_{16}$ | $\phi_{10}$ | $\phi_{18}$ | $\phi_{8}$ | $\phi_{20}$ | PILOT (14) | %FUEL | AIR-LBS/S |
|---|---|---|---|---|---|---|---|---|---|
| AIR SPLIT | 0.085 | 0.085 | 0.17 | 0.17 | 0.245 | 0.245 | | | |
| | 0.5 | 0.5 | 0.5 | 0.5 | 0.5 | 0.5 | 0 ~ 1% | 100 | 1000 |
| | 0.35 | 0.35 | 0.35 | 0.35 | 0.35 | 0.35 | 0 ~ 1% | 70 | 1000 |
| | 0.35 | 0.35 | 0.35 | 0.35 | 0.35 | 0.35 | 0 ~ 1% | 43 | 610 |
| | 0.46 | 0.46 | 0.46 | 0.46 | 0.46 | 0 | 0 ~ 1% | 43 | 610 |
| | 0.35 | 0.35 | 0.35 | 0.35 | 0.35 | 0 | 0 ~ 1% | 32 | 610 |
| | 0.45 | 0.45 | 0.45 | 0 | 0.45 | 0 | 0 ~ 1% | 32 | 610 |
| | 0.35 | 0.35 | 0.35 | 0 | 0.35 | 0 | 0 ~ 1% | 24 | 610 |
| | 0.41 | 0 | 0.41 | 0 | 0.41 | 0 | 0 ~ 1% | 24 | 610 |
| | 0.35 | 0 | 0.35 | 0 | 0.35 | 0 | 0 ~ 1% | 21 | 610 |
| | 0.7 | 0 | 0.7 | 0 | 0 | 0 | 0 ~ 1% | 21 | 610 |
| | 0.35 | 0 | 0.35 | 0 | 0 | 0 | 0 ~ 1% | 11 | 610 |
| | 0.7 | 0 | 0 | 0 | 0 | 0 | 0 ~ 1% | 11 | 610 |
| | 0.35 | 0 | 0 | 0 | 0 | 0 | 0 ~ 1% | 7 | 610 |
| | 0 | 0 | 0 | 0 | 0 | 0 | 0 ~ 7% | 7 | 610 |

INTERNAL FLUID ATOMIZER

PREMIXED LIQUID FUEL OPERATION

FLASHBACK RESISTANT FUEL STAGED PREMIXED COMBUSTOR

This application is a continuation of application Ser. No. 07/738,990, filed Aug. 1, 1991, now abandoned.

BACKGROUND OF THE INVENTION

This invention relates to premixed combustion systems which employ flashback resistant and highly efficient and compact premixing tubes. This system also achieves low emissions of oxides of nitrogen ($NO_x$), carbon monoxide (CO) and unburned hydrocarbons (UHC) over a large portion of the operating range of the engine.

DESCRIPTION OF THE RELATED ART

It is known, in prior combustor systems, to make use of designs incorporating premixed fuel and air to reduce flame temperatures and thus $NO_x$ emissions. In each of these systems the premixer is easily damaged by flame flashback into the premixer which occasionally occurs during transient events such as compressor stall. In addition, many of the proposed premixed combustion systems lack the ability to produce low emissions of $NO_x$, CO and UHC over a significant portion of the engine's operating range. Such performance is advantageous in engine applications that require significant reduced power operation such as gas pipeline and oil platform compressor drive applications.

It is apparent from the above that there exists a need in the art for a premixed air/fuel combustor system which efficiently mixes the fuel and air through simplicity of parts and uniqueness of structure, and which at least equals the combustion characteristics of known premixed air/fuel combustors, but at the same time substantially reduces the likelihood of damage by flame flashback and offers low emissions of $NO_x$, CO and UHC over a significant portion of the engine's operating range. It is the purpose of this invention of fulfill this and other needs in the art in a manner more apparent to the skilled artisan once given the following disclosure.

SUMMARY OF THE INVENTION

Generally speaking, this invention fulfills these needs by providing a combustor system, comprising a combustion chamber for combusting a mixture of fuel and air, premixing combustor tubes for premixing said fuel and air before said fuel and air enter said combustion chamber, said tubes having first and second ends with holes located along said first end and said second end being substantially located within said combustion chamber, a fuel introduction means connected to said first end of said premixing combustor tubes; an air introduction means for introducing air into said premixing combustion tubes; and control means for controlling the fuel and air introduction means.

In certain preferred embodiments, the fuel and air are mixed in the premixing combustor tubes such that the fuel and air are substantially completely mixed before they enter the combustion chamber. Also, the control means allows the system to be run at substantially less than 100% of its maximum load operation. Finally, the combustor system can be operated with gaseous or liquid fuels.

In another further preferred embodiment, the likelihood of an increase in CO and UHC emissions is minimized when the combustor system is run at substantially less than 100% of its maximum load operation.

In particularly preferred embodiments, the combustor system of this invention comprises a combustion chamber, 42 premixing tubes with their ends arranged in a staggered orientation within the combustion chamber, a fuel/air controller which controls the fuel and air being introduced into the premixing tubes and the combustor such that the combustor system can be run at substantially less than 100% of its maximum load operation while still reducing the likelihood of increased CO and UHC emissions.

The preferred combustor system, according to this invention, offers the following advantages: easy assembly and repair; good stability; excellent economy; improved load operation performance; high strength for safety; reduced likelihood of an occurrence of flashback; and good fuel efficiency. In fact, in many of the preferred embodiments, these factors of excellent economy, improved load operation and reduced likelihood of an occurrence of flashback are optimized to an extent considerably higher than heretofore achieved in prior, known combustor systems.

BRIEF DESCRIPTION OF THE DRAWINGS

The above and other features of the present invention which will become more apparent as the description proceeds are best understood by considering the following detailed description in conjunction with the accompanying drawings wherein like characters represent like parts throughout the several views and in which:

FIG. 6 is a fuel schedule, according to the present invention;

DETAILED DESCRIPTION OF THE INVENTION

In order to achieve extremely low emissions of $NO_x$ it is known that the flame temperature must be maintained below 2800° F. To achieve low emissions of CO and UHC the flame temperature must be kept above 2500° F. Thus, to simultaneously achieve low emissions of $NO_x$, CO and UHC, the flame temperature must be maintained between 2500° and 2800° F.

In the design of a premixed combustion system, the air and fuel flows are adjusted to achieve a flame temperature of approximately 2800° F. at full engine power. As the requirement of engine power is reduced, the flow of fuel is reduced. The air flow through a gas turbine engine also falls as the power is reduced but at a slower rate than the fuel flow. Therefore, the flame temperature drops as the power is reduced. If the flame temperature is allowed to drop below 2500° F., high levels of CO and UHC emissions result. Thus, fuel flow to various parts of the combustor must be completely shut off, thus allowing the fuel flow and flame temperature to increase (but not above 2800° F.) in those regions of the combustor which maintain fuel flow and flame. This process is referred to as fuel staging.

It is important that all regions which maintain flame be aerodynamically shielded from those regions of the combustor in which the fuel and flame were shut off. In this manner, the proper fuel/air mixture can be maintained to give flame temperatures between 2500° and 2800° F. in the active regions of the combustor.

It is also important that the velocity of the fuel/air mixture passing through the premixing tube be maintained at a sufficiently high value to keep flames from anchoring to the upstream end of the mixing tube in the event of, for example, a momentary flashback. Thus, if air flow through the gas turbine is momentarily interrupted, by compressor stall, for example, and the flame flashes back into the premixing tube, it is blown out as soon as the airflow through the gas turbine is restored to normal levels and damage to the premixer is thus avoided.

Figure 1:
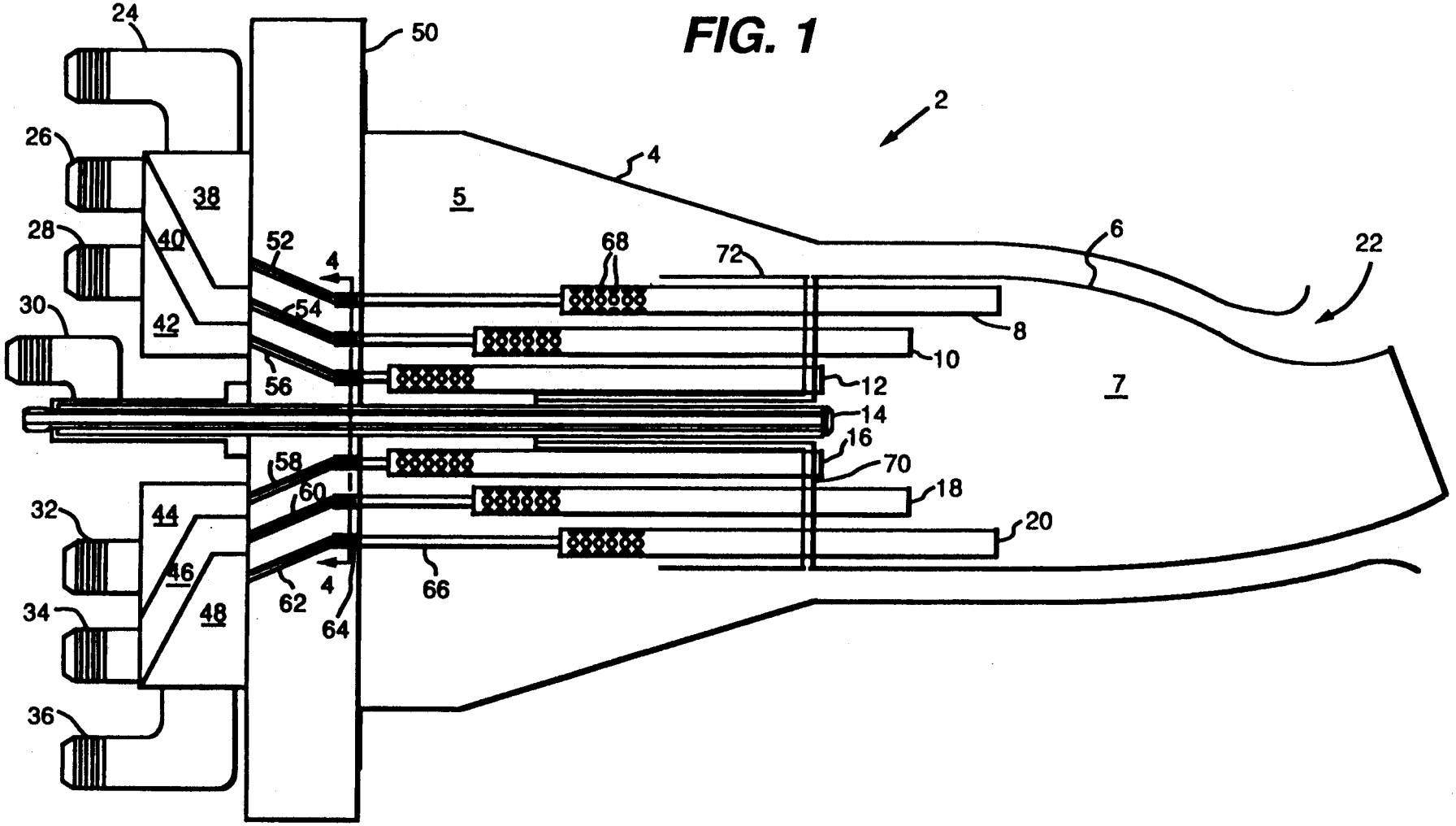
FIG. 1 is a side plan view of a premixed combustor system, according to the present invention.
Figure 5:
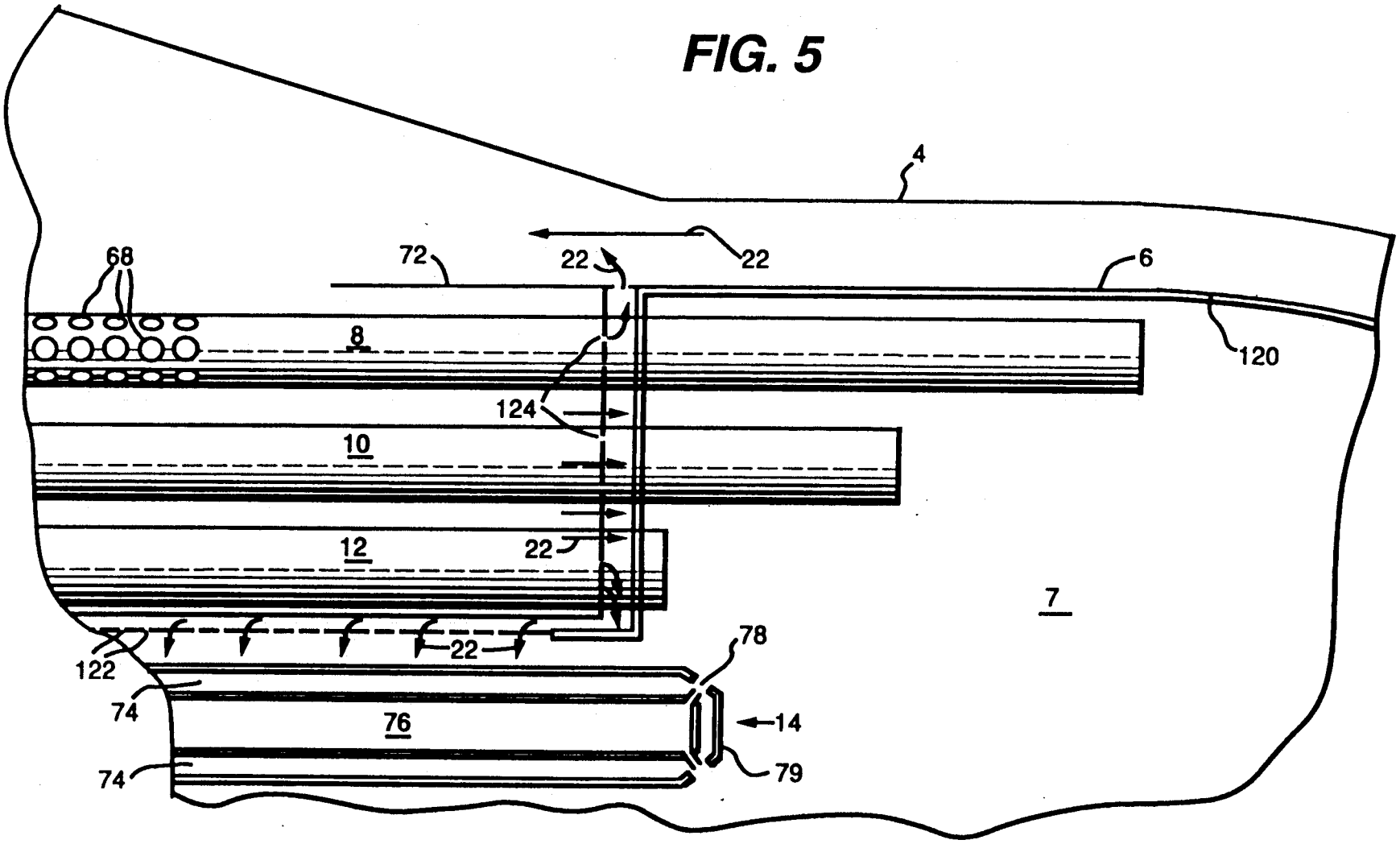
FIG. 5 is a detailed side plan view of the premixed combustor system showing the staggered arrangement of the premixed combustor tubes and the air assist fuel nozzle.

With reference first to FIG. 1, premixed combustor 2 is illustrated. Combustor 2 includes outer shell 4, diffuser 5, liner 6, combustion chamber 7, premixing tubes 8,10,12,16,18,20, pilot nozzle 14, inlet air 22, fuel stage 50, and fuel manifolds 24,26,28,30,32,34,36. Located within outer shell 4, which is, preferably, constructed of any suitable steel is liner 6. Liner 6, preferably, is constructed of Hastelloy ®X, manufactured by International Nickel Company located in Huntington, W. Va. A thin heat resistant ceramic coating 120 (FIG. 5), preferably, of partially stabilized zirconia having a thickness of approximately 0.030 inches is applied to the inside surface of liner 6 by conventional coating techniques, for example, plasma spraying (FIG. 5). Coating 120 helps protect liner 6 from the adverse heating affects of the combustion that takes place in chamber 7. Liner 6 encloses combustion chamber 7. Combustion chamber 7 is where the fuel and air 22 are combusted.

Located along the wall of liner 6 and positioned within liner 6 is a staggered arrangement of premixing combustor tubes 8,10,12,16,18,20. Tubes 8,10,12,16,18,20 are positioned within combustion chamber 7 in order to substantially reduce the likelihood of an increase in CO and UHC as engine power is reduced.

Figure 2:
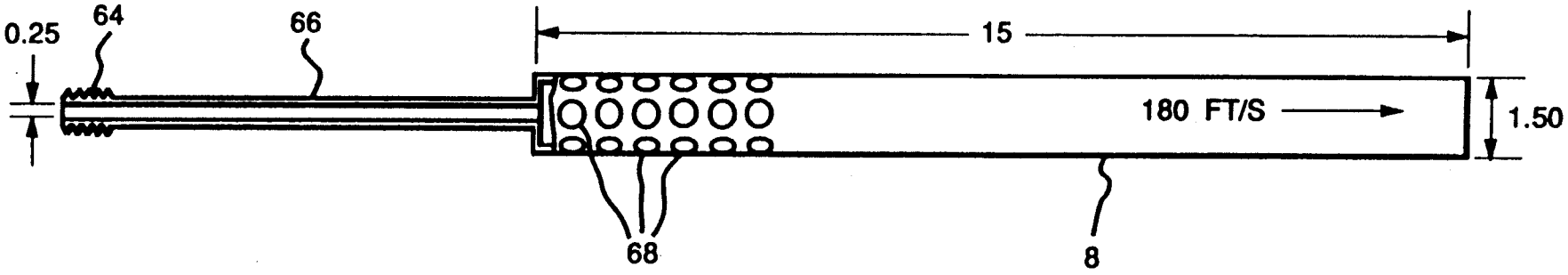
FIG. 2 is a detailed side plan view of the premixing combustor tubes.

With respect to FIG. 2, the specific construction of combustion tubes 8,10,12,16,18,20 can be seen. It is to be understood that while the tube in FIG. 2 is labeled with an 8, tubes 10,12,16,18,20 are constructed substantially the same way. Tube 8, preferably, is 15 inches long along the 1.50 inches diameter and 0.25 inches in diameter along extension 66. It is to be understood that tube 8 must have a length-to-diameter ratio of about 10 to assure good air and fuel mixing before entering chamber 7. Tube 8, preferably, is constructed of Hastelloy ®X. Tube 8 also contains approximately 36 holes 68, preferably, having a diameter of 0.375 inches which are formed in tube 8 by conventional hole forming techniques, for example, metal punching. Holes 68 allow air 22 to enter tube 8. Tube 8 also includes extension 66 and threads 64. Extension 66 can be of varying lengths in order to provide the proper stagger arrangement with tubes 8,20 having the longest extensions 66 and tubes 10,16 having the shortest extensions 66 (FIG. 1).

As shown in FIG. 1, threads 64 of tubes 8,10,12,16,18,20 are threadedly attached to fuel stage 50. Fuel stage 50, preferably, is constructed of any suitable metallic substance, such as steel. Located within fuel stage 50 are inlets 52,54,56,58,60,62 which are connected to threads 64 and extensions 66 of tubes 8,10,12,16,18,20, respectively. Conventional manifold inlets 38,40,42,44,46,48 are connected by conventional connectors to inlets 52,54,56,58,60,62, respectively. Conventional fuel manifolds 24,26,28,32,34,36 are connected by conventional connectors to manifold inlets 38,40,42,44,46,48, respectively.

Figure 3:
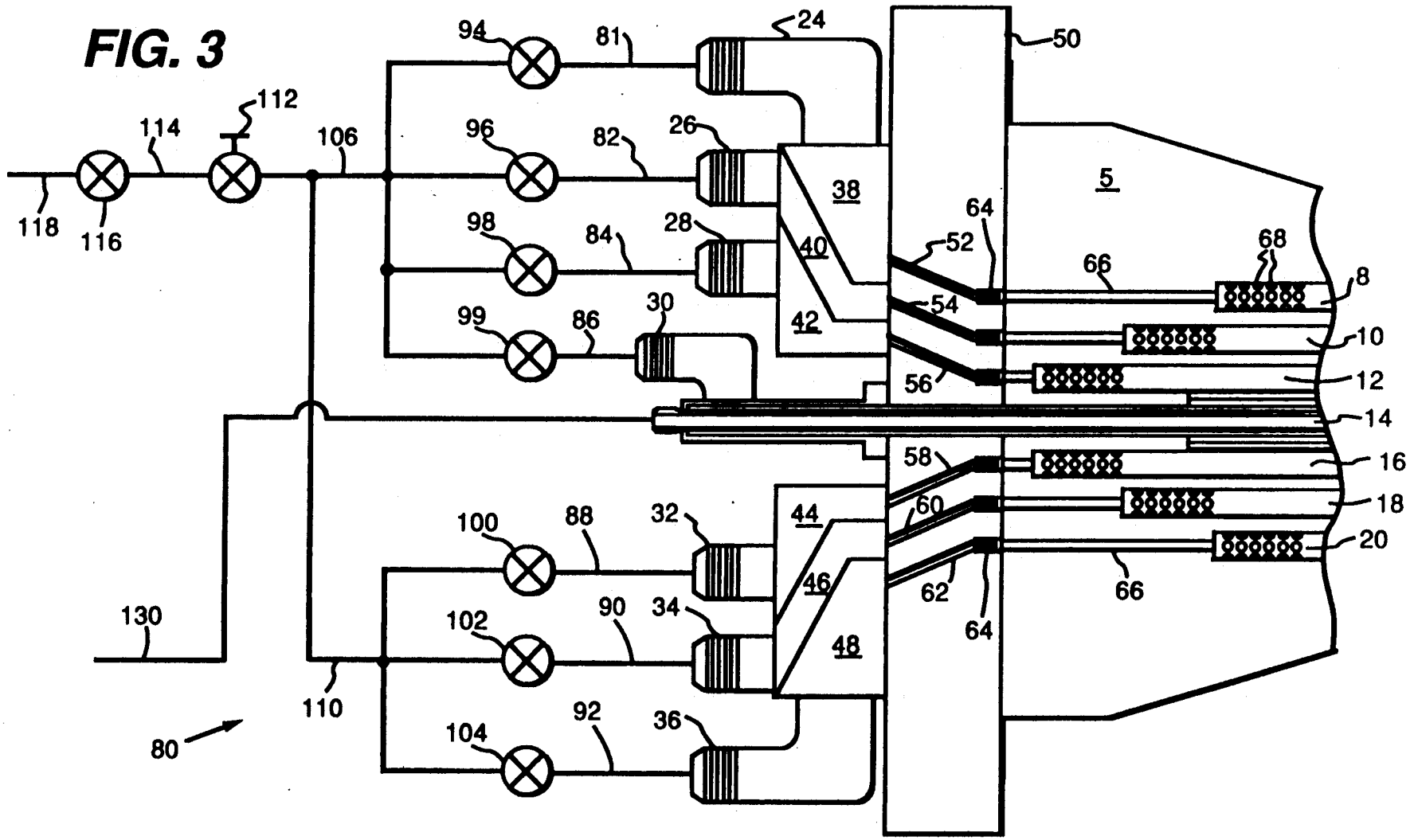
FIG. 3 is a schematic drawing of the fuel control system and the fuel manifolds.

With respect to FIG. 3, fuel control system 80 is illustrated. Fuel control system 80 consists of fuel manifolds 24,26,28,30,32,34,36, inlet lines 81,82,84,86,88,90,92, valves 94,96,98,99,100,102,104, conduit lines 106,110, control valve 112, line 114, shut off valve 116, fuel inlet line 118. In particular, gaseous fuel from a fuel source, preferably, a natural gas source (not shown) enters fuel inlet line 118 and proceeds past shut off valve 116 to line 114. Fuel in line 114 proceeds to control valve 112. After leaving control valve 112, the fuel proceeds along conduit line 106 to valves 94,96,98,99 and along conduit line 110 to valves 100,102,104. Fuel then can enter inlet lines 81,82,84 and 86,88,90,92 from valves 94,96,98,99,100,102,104, respectively. Finally, fuel from inlet lines 81,82,84,86,88,90,92 enters fuel manifolds 24,26,28,30,32,34,36, and ultimately, tubes 8,10,12,16,18,20 and pilot nozzle 14.

Figure 4:
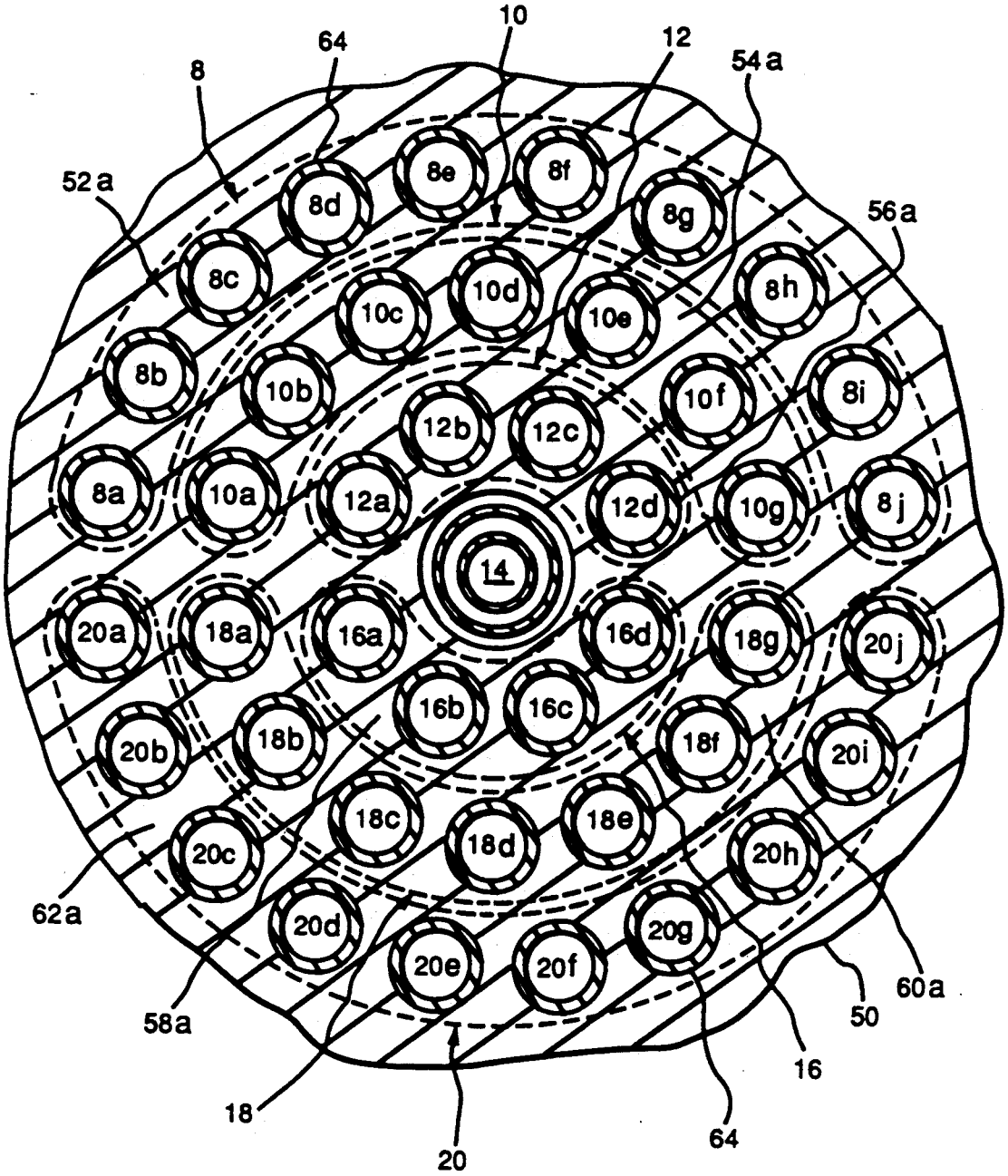
FIG. 4 is an end view of the premixing combustor tubes bundle and fuel system taken along lines 4—4 in FIG. 1.

FIG. 4 shows how tubes 8,10,12,16,18,20 are arranged in a circular bundle. In particular, there are, preferably, ten tubes 8 (numbered **8*a*–8*j*), ten tubes 20 (numbered 20*a*–20*j*), seven tubes 10 (numbered 10*a*–10*g*), seven tubes 10 (numbered 18*a*–18*g*), four tubes 12 (numbered 12*a*–12*d*), and four tubes 16 (numbered 16*a*–16*d*) along with nozzle 14 situated within the bundle. As can be seen tubes 8*a*–8*j* and 20*a*–20*j* are located in an outer ring of the bundle. Also, tubes 10*a*–10*g* and 18*a*–18*g* are located in the intermediate ring and tubes 12*a*–12*d* and 16*a*–16*d* are located in the inner most ring. Finally, nozzle 14** is located at substantially the center of the bundle.

Tubes **8*a*–8*j* are connected to inlet 52*a* in that, preferably, inlet 52*a* is preferably a semi-circular enclosed shape with separate outlet ports connecting each of extensions 66 of tubes 8*a*–8*j* to create a fuel inlet apparatus from the gas source (not shown) to each tube 8*a*–8*j*. Tubes 20*a*–20*j* are connected to inlet 62*a* in substantially the same manner as tubes 8*a*–8*j* are connected to inlet 52*a*. Likewise tubes 10*a*–10*g* and 18*a*–18*j* are connected to inlets 54*a* and 60*a*, respectively, in the same manner as tubes 8*a*–8*j* are connected to inlet 52*a*. Finally, tubes 12*a*–12*d* and 16*a*–16*d* are connected to inlets 56*a* and 58*a*, respectively, in the same manner as tubes 8*a*–8*j* are connected to inlet 52*a***.

With respect to FIG. 5, the stagger arrangement of tubes 8,10,12 is more clearly illustrated. In particular, tubes 8,10,12 are rigidly fastened by conventional fastening techniques, such as welding, to liner 6 such that tube 8 projects further into chamber 7 than tube 10 which, in turn, projects further into chamber 7 than tube 12. It is to be understood that while only tubes 8,10,12 are shown, the same stagger arrangement discussion is applied to tubes 16,18,20, respectively. As mentioned earlier, liner 6 is coated with a heat resistant coating 120 along its inner surface where it forms combustion chamber 7. Also, liner 6 contains holes 122 which are formed, preferably, by metal punching. It is to be understood that liner 6 is not treated with coating 120 at the area where holes 122 are located because coating 120 would not properly adhere the areas around holes 122. Holes 122 allows air 22 to enter into chamber 7 and interact with nozzle 14.

Located away from the outer wall liner 6, is cooling wall 72. Wall 72, preferably, is constructed of any suitable heat resistant stainless steel. Holes 124 are formed in wall 72 by conventional hole forming techniques, such as metal punching. Holes 124 allow air 22 to cool the back side of liner 6. In particular, as air 22 rushes over the gap between wall 72 and liner 6, the velocity of the air creates a well known low pressure region in the space between wall 72 and liner 6. This low pressure zone then causes air to be drawn in through holes 124, along the outer wall of liner 6 and out between wall 72 and liner 6 which cools liner 6 near the area where tubes 8,10,12 are located within liner 6. It is to be understood that while holes 124 and the low pressure created by the velocity of the air 22 rushing past the gap between wall 72 and liner 6 are used to cool liner 6 near the area where tubes 8,10,12 are located within liner 6, the well known use of regenerative cooling by back side convection is utilized to cool chamber 7 and liner 6 near the area where the products of combustion exit chamber 7.

In operation of combustor 2, the gas from the natural gas source (not shown) has already been turned such that it is flowing through fuel manifolds 24,26,28,32,34,36. Also, fuel and air are being premixed in premixing tubes 8,10,12,16,18,20 such that the mixture is flowing along tubes 8,10,12,16,18,20, preferably, at around 180 ft/s. The velocity of 180 ft/s is employed because this fuel/air mixture velocity should also keep the flame in chamber 7 from going into the tubes thus, creating flashback. Finally, air 22 is entering combustor 2 near the exit area of chamber 7, preferably, at around 100–200 ft/s. As air 22 enters diffuser 5, the air velocity slows down in a controlled manner due to the construction of diffuser 5 and air 22 enters holes 68 in tubes 8,10,12,16,18,20, holes 124 in wall 72 and holes 122 in liner 6. Natural gas can also be introduced into manifold 30 and injected and burned as a pilot flame from nozzle 14. This pilot would burn as a standard diffusion flame and could help stabilize the premixed combustion from tubes 8,10,12,16,18 and 20. At this point in time, combustor 2 should be operating at 100% of its maximum load operation as shown in line 1 in FIG. 6.

FIG. 6 shows the fuel schedule for the fuel/air mixtures in tubes 8,10,12,16,18,20. In particular, the fuel-to-air ratio divided by the stoichiometric fuel/air ratio (this normalized fuel-to-air ratio will be referred to as the equivalence ratio) for tubes 8,10,12,16,18,20 are shown along with the diffusion fraction from tube pilot 14, the percentage of fuel being introduced into fuel manifolds 24,26,28,32,34,36, the fraction of air flowing through tubes 8,10,12,16,18,20 and the air split and amount of total air in combustor 2. As discussed earlier, and as shown in line 1 of FIG. 6, during maximum load operations, with the air split remaining approximately constant throughout the entire turndown of combustor 2, $\phi_8, \phi_{10}, \phi_{12}, \phi_{16}, \phi_{18}, \phi_{20}$, are all equal to 0.5 and the air flow percentage of 100% with a fuel percentage of 100%. If it is desired, for example, to run combustor 2 at around 70% of its maximum load operation, the operator reduces the total fuel flow to 70% of the maximum value which lowers the equivalence ratio in all tubes to a value of approximately 0.35. This is shown in line 2 of FIG. 6. To operate in the 43 to 70% power range, the air flow is reduced by modulating the gas turbine inlet guide vanes. Simultaneously the fuel flow is reduced in a fashion to keep the equivalence ratio at 0.35. This is depicted in line 3 of FIG. 6. To go lower in power it is necessary to first shut off value 104 thus cutting fuel off to tubes **20*a* to 20*j*. The equivalence ratio to the remaining tubes increases to a value of 0.46 as shown in line 4 of FIG. 6. Fuel flow is then reduced to tubes 8,10,12,16,18 until an equivalence ratio of 0.35 is attained. The gas turbine is at approximately 32% power. To go lower in power, valve 102 is shut and the fuel flow to the remaining tubes is reduced. This is depicted in lines 5 and 6 of FIG. 6**. This procedure is followed thus resulting in lowering the power of the gas turbine from maximum to minimum load.

Tubes 8,10,12 (or 20,18,16) are shown staggered. In this manner, the air flowing from tube 8 (or 20) during part load operation in which no fuel is added to tube 8 (or 20) does not interact with the fuel/air mixture from tubes 10 and 12 (or 16 and 18) and quench the flame thus causing high levels of CO and UHC. Similarly, when fuel is shut off to tube 10 (or 18) the air from this tube does not quench the flame from tube 12 (or 16).

Figures 7, 7A:
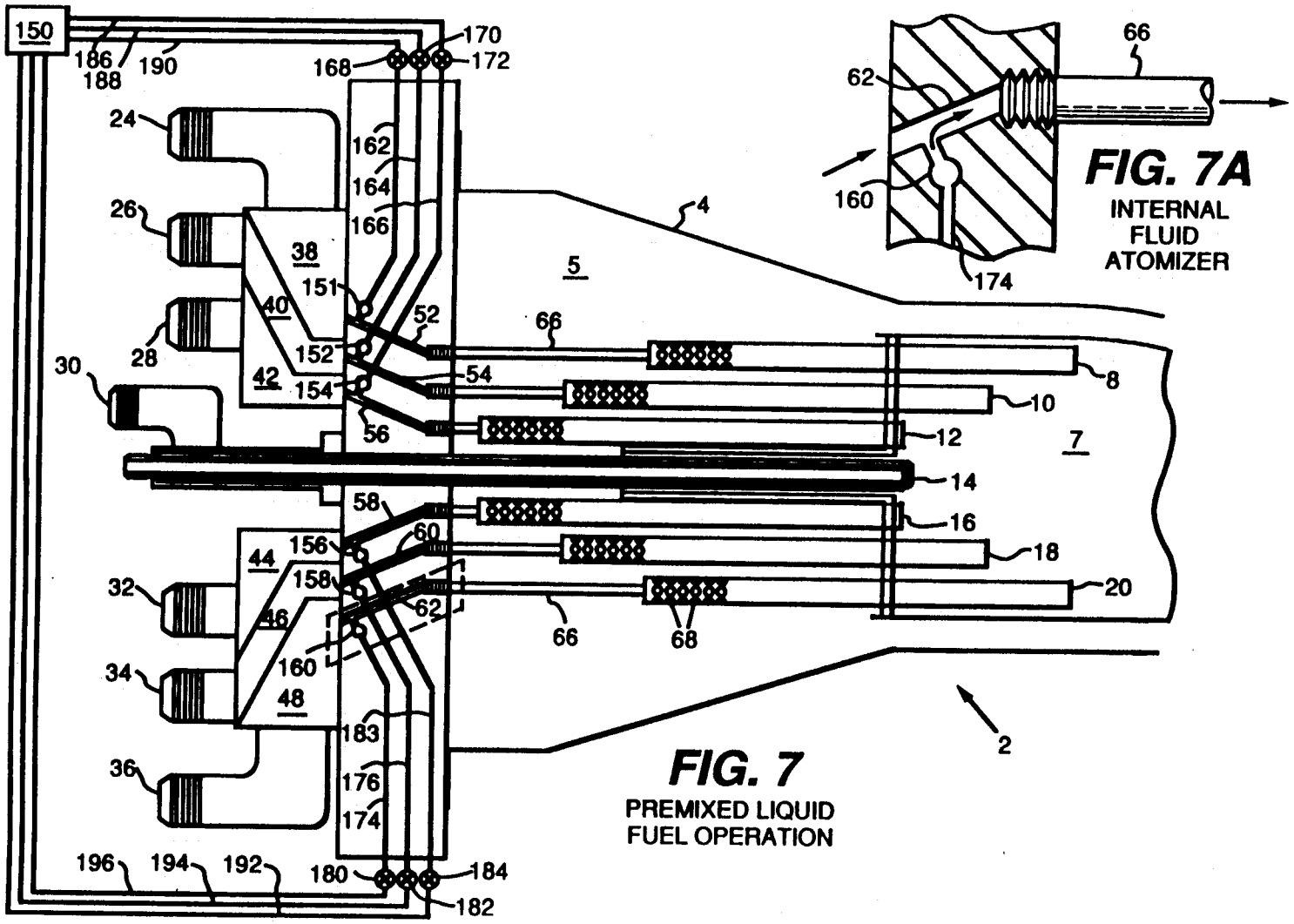
FIG. 7 is another embodiment of the fuel control system and fuel manifolds.
FIG. 7A is a detailed drawing of the liquid fuel stage as depicted in the dotted line area of FIG. 7.

FIG. 7 is another embodiment of the present invention. The same numbers found in FIGS. 1 and 7 represent like parts. FIG. 7 illustrates a premixed liquid fuel combustor 2. In particular, liquid fuel, preferably, #2 fuel oil is pumped by a conventional apparatus (not shown) to fuel valve 150. The liquid fuel is then transported from control valve 150 along conduit lines 186, 188, 190, 192, 194, 196, to staging valves 172,170,168,184,182,180, respectively. As before with the initial operation of combustor 2 at 100% of its maximum load operation, valves 172,170,168,184,180, are opened so fuel can flow through inlet lines 166,164,162,183,176,174 respectively, to liquid fuel manifolds 154,152,151,156,158,160, respectively. However, now only air is being transported through manifolds 24,26,28,32,34,36 and inlets 52,54,56,58,60,62.

As more clearly shown in FIG. 7A, as air is fed through inlet 62, preferably, at a pressure which is 50% higher than the pressure in chamber 7, typically, 150–600 psi. The liquid fuel flows into inlet 62, the high velocity air atomizes the liquid fuel prior to it being introduced into tube 20. The liquid fuel is modulated or staged in a manner similar to the gaseous fuel operation to achieve reduced load operation while maintaining low emissions of UHC and CO.

In yet another embodiment of the present invention nozzle 14 is used to inject a mixture of oil and water thus providing dual fuel capability with low emissions of NOx. (The water suppresses the flame temperature.) As shown in FIG. 5, nozzle 14 consists of gas inlet tube 74, fuel inlet tube 76, outlets 78 and end cap 79. In particular, when burning #2 fuel oil mixed with water, this mixture is transported from fuel manifold 130 to fuel inlet tube 76 where the fuel is sprayed out of outlets 78. The water is mixed with the fuel oil to create the advantageous lower flame temperature in chamber 7. It is preferred that there be at least 6–12 outlets attached by conventional attachment means, such as welding, to the end of tube 76 near end cap 79. Also, air is introduced along manifold 30 (FIG. 3) to gas inlet tube 74. The air flowing in tube 74 should be, preferably, at a pressure which is 20% higher than the pressure in chamber 7 which is preferably, between 150 and 600 psi. The air in tube 74 interacts with the fuel that flows out of outlets 78 to create an atomized liquid fuel mist which can be combusted in chamber 7. It is to be understood that if a steam source is readily available as is the case with a conventional combined cycle gas turbine, the steam would be transported through tube 74 while only unmixed #2 fuel oil would be transported through tube 76. In this manner, as the oil leaves outlets 78 the oil can be atomized by the high velocity steam which also serves to reduce the flame temperature in zone 7.

Once given the above disclosure, many other features, modifications or improvements will become apparent to the skilled artisan. Such features, modifications or improvements are, therefore, considered to be apart of this invention, the scope of which is to be determined by the following claims.

What is claimed is:

1. A combustor system, comprising:

a combustion chamber for combusting a mixture of a first fuel and air;

a liquid fuel introduction means substantially located within said combustion chamber;

premixing combustor tubes for premixing said first fuel and air in said tubes before said first fuel and air enter said combustion chamber, said tubes having first and second ends with holes located along said first end and said second end being substantially located within said combustion chamber; wherein said premixing tubes are further comprised of a bundle of tubes substantially centered around said liquid fuel introduction means with said bundle being divided into at least three consecutive rings of tubes said consecutive rings being of varying diameters with said third ring encircling said second ring which encircles said first ring;

a fuel introduction means connected to said first end of said premixing combustor tubes for introducing said first fuel into said tubes;

an air introduction means for introducing air into said premixing combustor tubes; and control means for controlling said first fuel, said liquid fuel and said air while maintaining low emissions and a low flame temperature in said combustion chamber, wherein said combustor chamber is further comprised of:

an outer wall;

an inner wall;

a heat resistant coating located substantially along a portion of said inner wall; and perforations located substantially along another portion of said inner wall and along a portion of said outer wall.

2. The combustor system, according to claim 1, wherein said first ring is positioned axially and radially further within said chamber than said second ring and said second ring is positioned axially and radially further within said chamber than said third ring.

3. The combustor system, according to claim 1, wherein said fuel introduction means is further comprised of;

a fuel source means;

a valve means;

a first fuel conduit means connecting said fuel source means and said valve means;

a manifold means;

a fuel inlet means connecting said fuel conduit means to said manifold means; and a second fuel conduit means connecting said manifold means to said premixing combustor tubes.

4. The combustor system, according to claim 3, wherein said second fuel conduit means is further comprised of:

a liquid fuel inlet means.

5. The combustor system, according to claim 1, wherein said air introduction means is further comprised of:

an air source;

a diffuser; and an air transport means substantially connecting said air source and said diffuser.

6. The combustor system, according to claim 1, wherein said air introduction means is further comprised of:

an air source which provides an air velocity of at least 100 ft/s to substantially prevent damage to said combustor tubes due to flashback.

7. The combustor system, according to claim 1, wherein liquid fuel introduction means is further comprised of:

a liquid fuel conduit means;

an air conduit means which transports air; and a liquid fuel spray means connected to said liquid fuel conduit means such that when said liquid fuel is ejected from said spray means, said air in said air conduit means interacts with said ejected fuel to create a mist of fuel which is burned in said combustion chamber.

8. The combustor system, according to claim 1, wherein said combustor system is further comprised of:

a second wall spaced away from and parallel to a portion of said outer wall of said combustion chamber and holes located in a portion of said second wall adjacent to said premixing combustor tubes.

* * * * *